US006595658B2

(12) United States Patent
Tsai

(10) Patent No.: US 6,595,658 B2
(45) Date of Patent: Jul. 22, 2003

(54) DECORATIVE ASSEMBLY OF A LIGHT STRING

(76) Inventor: Chin-Sung Tsai, No. 178, Chung Shaio Road, Hsinchu (TW)

( * ) Notice: Subject to any disclaimer, the term of this patent is extended or adjusted under 35 U.S.C. 154(b) by 0 days.

(21) Appl. No.: 09/925,454

(22) Filed: Aug. 10, 2001

(65) Prior Publication Data

US 2003/0031013 A1 Feb. 13, 2003

(51) Int. Cl.[7] ..... F21S 13/14

(52) U.S. Cl. ..... 362/227; 362/252; 362/806; 362/249

(58) Field of Search ..... 362/122, 123, 362/249, 252, 806, 226, 227; D26/101, 127; 428/10

(56) References Cited

U.S. PATENT DOCUMENTS 1,530,229 A * 10/1922 Brown ..... 362/806
5,410,460 A * 4/1995 Liou ..... 362/250
6,030,670 A * 2/2000 Chang ..... 428/19

* cited by examiner

*Primary Examiner*—Sandra O'Shea
*Assistant Examiner*—Anabel Ton
(74) *Attorney, Agent, or Firm*—Rosenberg, Klein & Lee

(57) ABSTRACT

The present invention relates to a decorative assembly of a light string, which includes a main electrical wire and many bulb sets, wherein a connecting wire is winded with the main electrical wire and has many rods in interval. A plastic decorative assembly is provided with a bottom receiver for engaging with the rod of the connecting wire easily and firmly that provides the decorative assembly connected with the light string as a single decoration.

2 Claims, 2 Drawing Sheets

DECORATIVE ASSEMBLY OF A LIGHT STRING

BACKGROUND OF THE INVENTION

A light string includes a main electrical wire (1) connecting with many bulb sets (2), which provides decorative lighting effect by bulbs (21). In order to increase decorative effect, a decorative assembly is usually provided with the light string. For example in FIG. 1, there are several plastic leaves (3) directly tied on the main electrical wire (1). This prior structure will be troublesome in assembling each leaf (3) on the wire (3). The leaf (3) is possible to be loosened since tied strength with the wire (3) is obviously not enough.

Accordingly, the primary object of the invention is to provide a decorative assembly of a light string, which includes a connecting wire being winded with the electrical wire. The connecting wire has been provided with many rods for engaging with decorative assemblies firmly and easily. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
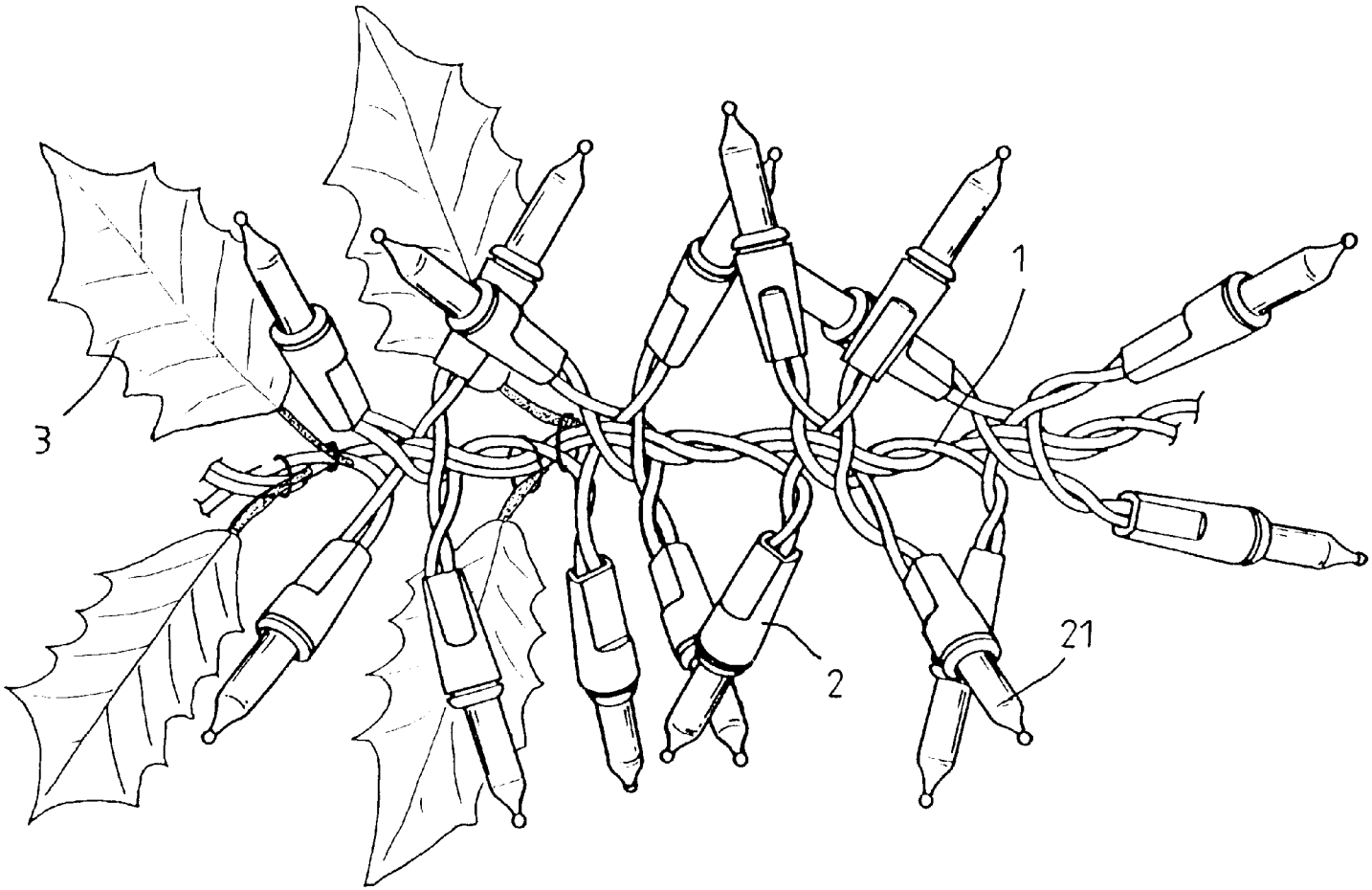
FIG. 1 (prior art)
FIG. 1 is a perspective view showing a prior light string connected with prior decorative assemblies.
Figure 2:
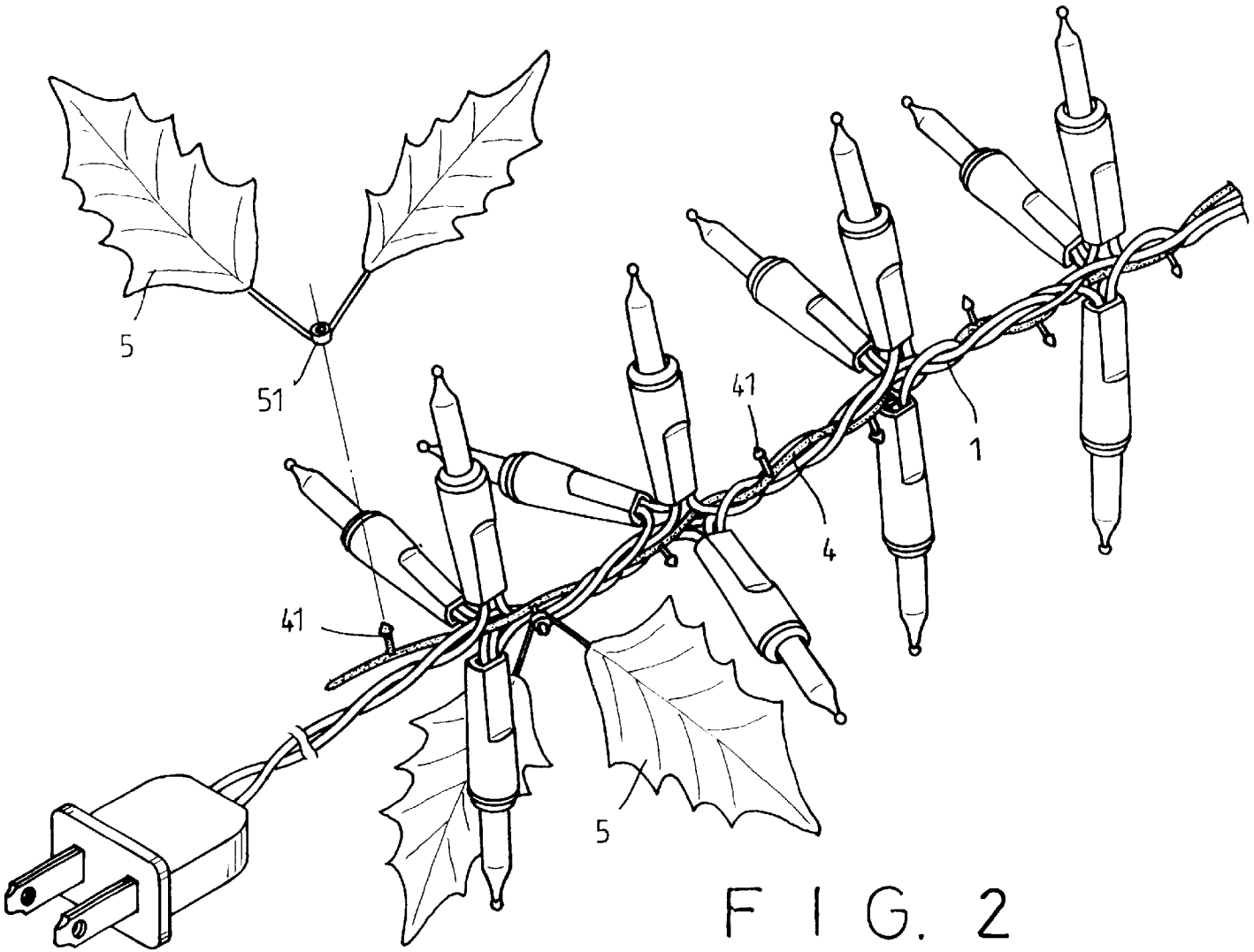
FIG. 2 is a perspective view showing a light string connected with decorative assemblies according to the present invention.

Referring to FIG. 2, the present invention relates to an improvement of a decorative assembly of a light string, which includes a main electrical wire (1) connecting with many bulb sets (2). The decorative assembly of this invention includes a connecting wire (4) being winded with the main electrical wire (1). There are many rods (41) formed on the connecting wire (4) in interval. Many plastic leaves (5) having a bottom receiver (51) are provided to engage with the rod (41) of the connecting wire (4). It can be found that the leaf (5) will be very easy to be safely connected on the connecting wire (4) by use of the receiver (51) engaged with the rod (41). The leaf (51) will not be released in ease after being engaged with the rod (41) having a big head. Thus, the decorative assembly, the plastic leaves in this embodiment, is connected with the light string conveniently and securely as a single decoration.

Accordingly, the present invention provides an invented design of a decorative assembly of a light string, which provides a novel connecting structure to connect the decorative leaves with the light string easily and firmly. It is to be understood that other pattern of the decorative assembly, such as flowers or fruits, can be used based on the said connecting structure of the merit of this invention. It obviously gains the utility and novelty for patent and is thus applied.

What is claimed is:

1. A decorative light string assembly comprising:

a longitudinally extended main electrical wire;

a plurality of light bulb sets coupled to said longitudinally extended main electrical wire;

a connecting wire woven with said main electrical wire and extending longitudinally therewith, said connecting wire having a plurality of rod members extending laterally therefrom in longitudinally spaced relationship and disposed at locations intermediate respective pairs of said plurality of light bulb sets, each of said rod members having a head portion at a distal end thereof, said head portion having a cross-sectional contour larger than a cross-sectional contour of an adjacent portion of said rod member; and, a plurality of decorative assemblies respectively coupled to said plurality of rod members, each of said decorative assemblies including a receiver having an annular contour for coupling to a corresponding one of said rod members and adapted for retention thereon by said head portion of said rod member.

2. The decorative light string assembly as recited in claim 1, wherein each of said decorative assemblies are simulative of an object selected from the group consisting of a leaf, a flower and a fruit.

* * * * *